US006126066A

United States Patent [19]

Peterson et al.

[11] Patent Number: 6,126,066

[45] Date of Patent: Oct. 3, 2000

[54] TEAR-STOP SCORE ENCIRCLING SINGLE OPENING CARRIER HANDLES

[76] Inventors: Christine L. Peterson, 4308 Courtesy La., Batavia, Ohio 45103; William L. Brown, 4210 N. Haven Dr., Mason, Ohio 45040

[21] Appl. No.: 09/464,017

[22] Filed: Dec. 15, 1999

[51] Int. Cl.[7] ..... B65D 5/468

[52] U.S. Cl. ..... 229/117.13; 229/117.12; 229/920

[58] Field of Search ..... 229/117.12, 117.13, 229/117.14, 920; 206/140, 141, 427, 434

[56] References Cited

U.S. PATENT DOCUMENTS

| | | | |
|---|---|---|---|
| 2,598,051 | 5/1952 | Guyer et al. | 229/117.13 |
| 4,463,852 | 8/1984 | Stone | 206/141 |
| 4,684,059 | 8/1987 | Rusnock | 206/427 |
| 4,966,324 | 10/1990 | Steel | 206/140 |
| 4,989,778 | 2/1991 | Saulas | 229/117.13 |
| 5,480,091 | 1/1996 | Stout | 229/920 |
| 5,906,313 | 5/1999 | Oliff | 229/117.13 |

FOREIGN PATENT DOCUMENTS

| | | | |
|---|---|---|---|
| 1602857 | 11/1981 | United Kingdom | 229/117.12 |

*Primary Examiner*—Gary E. Elkins
*Attorney, Agent, or Firm*—Ralph J. Skinkiss; Howard M. Cohn

[57] ABSTRACT

An elongate generally-rectangular single handle opening is disposed transversely across the top panel of a sleeve-type carrier. Optionally, a generally-rectangular stress-relief score line arrangement extends transversely completely across the top panel and down into the side panels, and is centered around the handle opening. A generally-rectangular tear-stop score line arrangement extends transversely only partially across the top panel, and encircles the handle opening between the handle opening and the stress-relief score line arrangement. In this manner, tears originating at the handle opening are substantially prevented from propagating across the top panel of the carrier and compromising the structural integrity of the carrier.

20 Claims, 3 Drawing Sheets

TEAR-STOP SCORE ENCIRCLING SINGLE OPENING CARRIER HANDLES

TECHNICAL FIELD OF THE INVENTION

The invention relates to paperboard cartons such as carriers for cans or bottles and, more particularly, to sleeve-type carriers having a carrying handle comprising a single elongate opening extending across a top panel of the carrier.

BACKGROUND OF THE INVENTION

Paperboard is used for packaging a wide variety of consumer products. Paperboard carriers having integral handles on a panel thereof are generally well known, such as for forming a carrier for cans or bottles. A typical handle comprises a single elongate opening extending transversely partially across a top wall of the carrier. The handle opening may be include a flap or flaps which are deflected with the user inserts their fingers into the opening. Examples of single opening handles for sleeve-type carriers can be found in U.S. Pat. Nos. 4,558,816 and 4,785,991.

When lifting a paperboard carrier with an integral handle and containing a reasonably heavy product, such as beverage cans or bottles, the paperboard fibers are stressed, possibly resulting in tearing of the paperboard and product displacement.

SUMMARY OF THE INVENTION

It is an object of the invention to provide an improved construction for a paperboard carrier, particularly a sleeve-type carrier having an integral handle.

Another object of the invention is to provide an improved construction for a paperboard carrier including a tear-stop score encircling the carrier handle.

According to the invention, a sleeve-type carrier and the paperboard blank for forming the carrier comprise a top panel, side panels, end panels and a bottom panel, all interconnected with one another; a handle opening extending transversely across the top panel; and a tear-stop score line arrangement disposed on the top panel, encircling the handle opening and extending transversely only partially across the top panel. The tear-stop score lines are provided closely adjacent the handle opening for substantially preventing tears originating at the handle opening from propagating across the top panel of the carrier and compromising the structural integrity of the carrier.

According to an aspect of the invention, the handle opening extends approximately 70–75% of the distance (width) across the top panel, and the tear-stop score line arrangement extends approximately 85–95% of the width across the top panel.

According to an aspect of the invention, the handle opening has a length dimension and a width dimension, the tear-stop score line arrangement has a length and a width dimension, the length dimension of the tear-stop score line arrangement is approximately 20–30% greater than the length dimension handle opening; and the width dimension of the tear-stop score line arrangement is approximately 2–2.5 times greater than the width dimension of the handle opening.

According to a feature of the invention, a stress-relief score line arrangement extends transversely completely across the top panel on either side of the handle opening, and the tear-stop score line arrangement is disposed approximately halfway between the handle opening and the stress-relief score line arrangement.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawings. The drawings are intended to be illustrative, not limiting. Although the invention will be described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Figure 1:
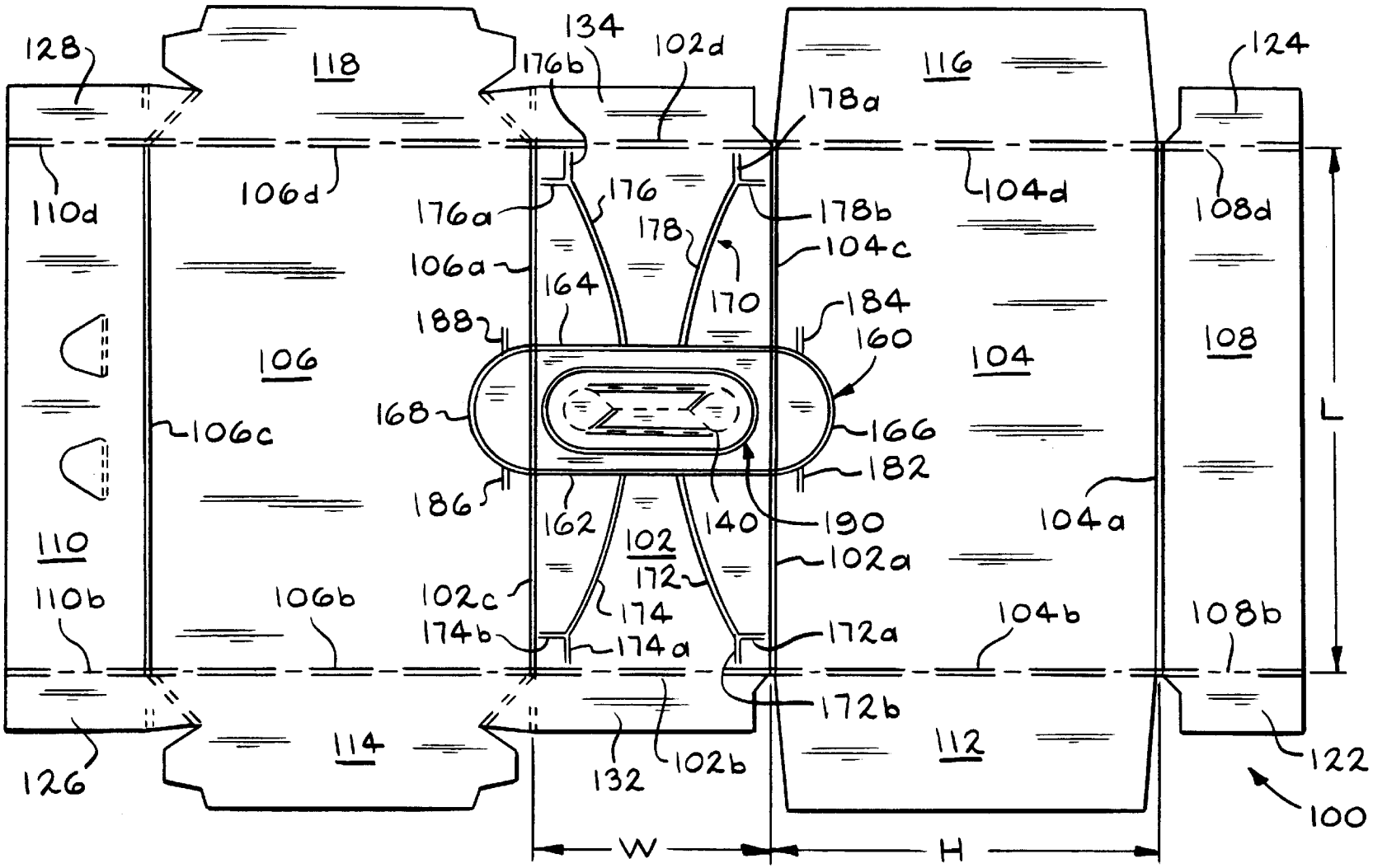
Figure 2:
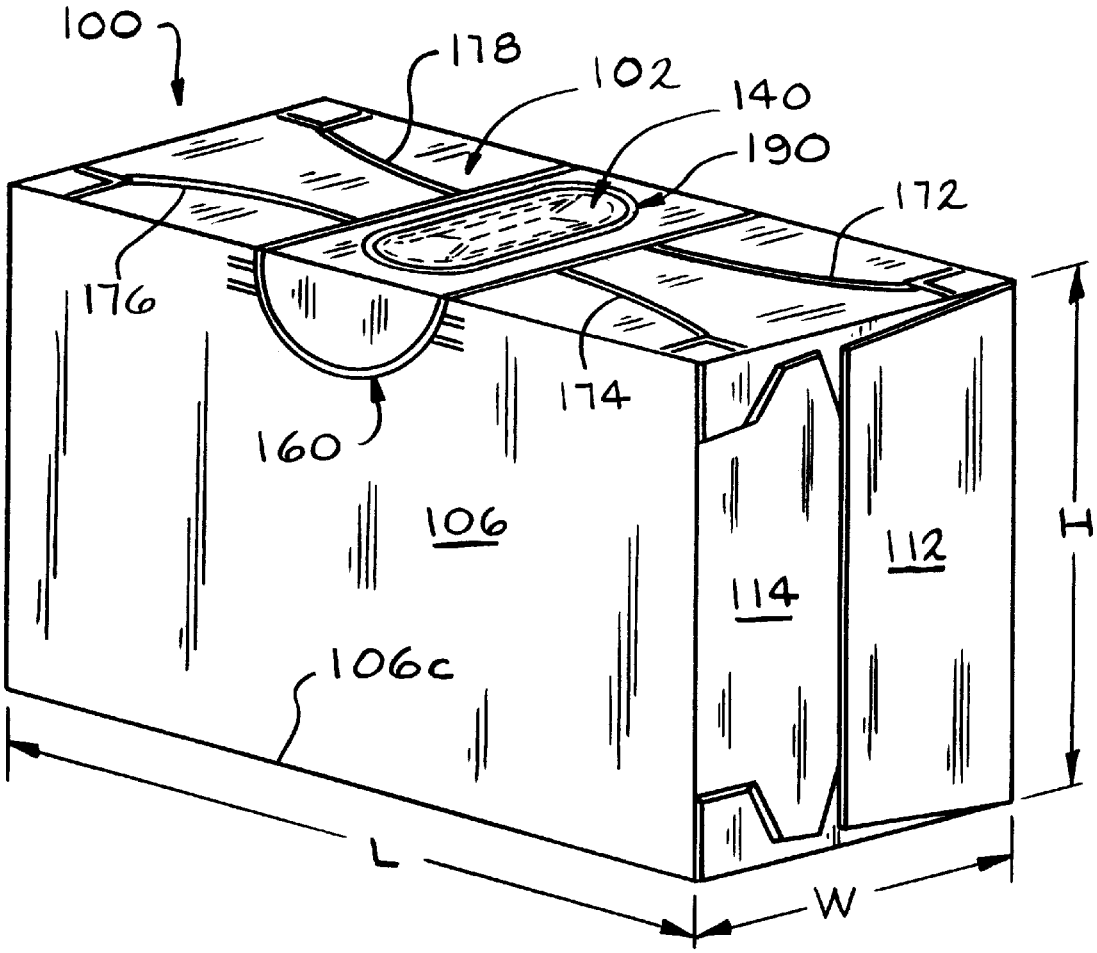

Elements of the figures are typically numbered as follows. The most significant digits (hundreds) of the reference number corresponds to the figure number. Elements of FIG. 1 are typically numbered in the range of 100–199. Elements of FIG. 2 are typically numbered in the range of 200–299. Similar elements throughout the drawings may be referred to by similar reference numerals. For example, the element 199 in a figure may be similar, and possibly identical to the element 299 in an other figure. In some cases, similar (including identical) elements may be referred to with similar numbers in a single drawing. For example, each of a plurality of elements 199 may be referred to individually as 199*a*, 199*b*, 199*c*, etc. Such relationships, if any, between similar elements in the same or different figures will become apparent throughout the specification, including, if applicable, in the claims and abstract.

Figure 3:
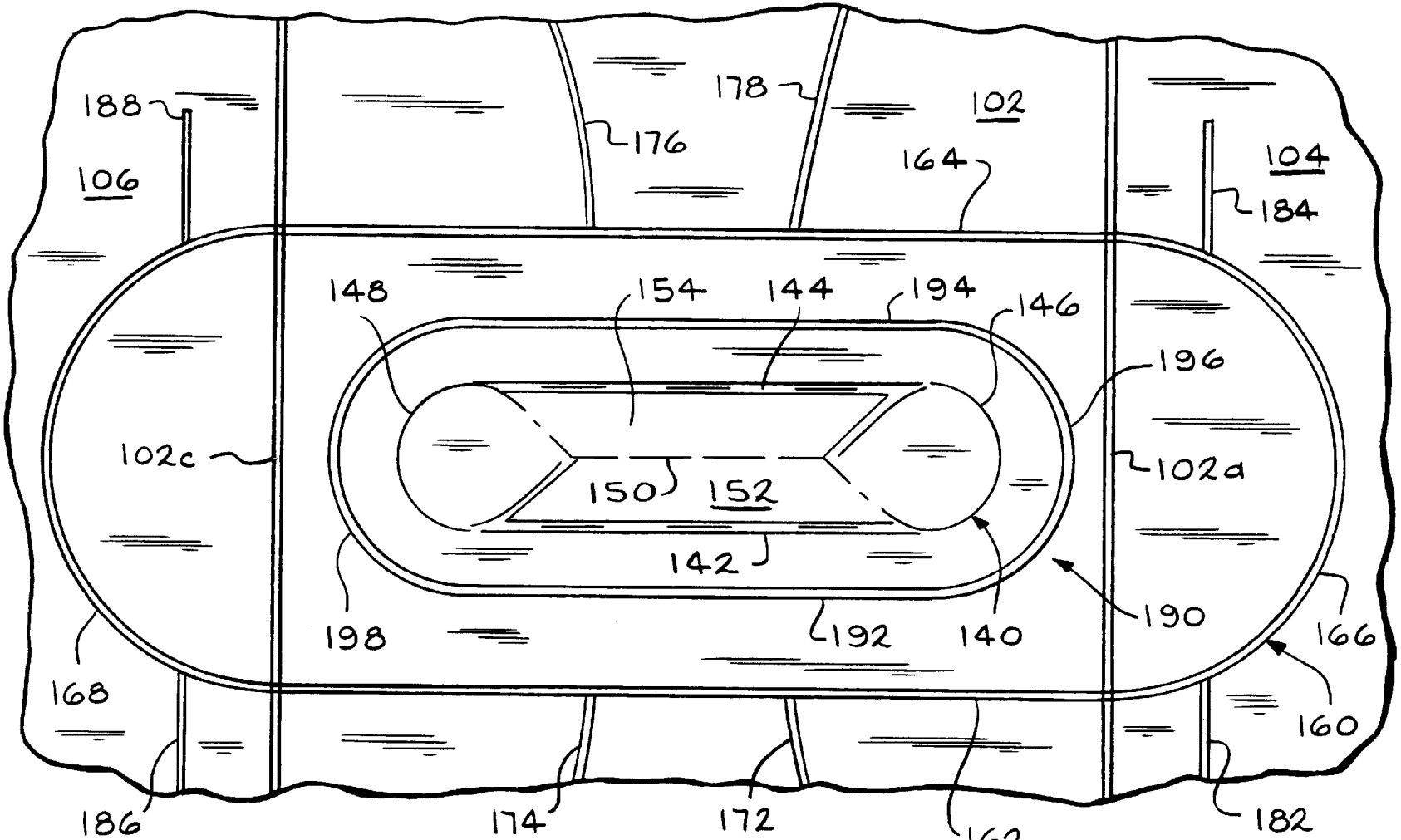

The structure, operation, and advantages of the present preferred embodiment of the invention will become further apparent upon consideration of the following description taken in conjunction with the accompanying drawings, wherein:

FIG. 1 is a plan view of paperboard blank for making the carrier of the present invention;

FIG. 2 is a perspective view of the carrier of the present invention, in an assembled condition; and FIG. 3 is a detailed view of a portion of the paperboard blank of FIG. 1, according to the invention.

DETAILED DESCRIPTION OF THE INVENTION

FIG. 1 illustrates a paperboard blank 100 for a carrier of the present invention in an unassembled condition, and FIG. 2 illustrates the assembled carrier 100. A carrier of this type is sometimes referred to as a "sleeve-type" carrier or as a "tube-style" carrier. The carrier 100 comprises a number of interconnected panels and flaps defined and foldably connected to one another by a plurality of score lines, described in greater detail hereinbelow. All of the panels and flaps are visible in FIG. 1, and only some of the panels and flaps are visible in FIG. 2. FIG. 3 is a detailed view of a portion of the paperboard blank 100.

As used herein, a "score line" is a rupturing of the surface of the blank paperboard sheet material, typically resulting in a depression on one side of the sheet and a welt on the other, which allows the sheet to be folded on that line.

A top panel 102 is generally rectangular and has four sides, each side defined by a respective score line 102*a*, 102*b*, 102*c*, 102*d*. The top panel 102 has a length "L" and a width "W".

A first side panel 104 is generally rectangular and has four sides, each side defined by a respective score line 104*a*, 104*b*, 104*c*, 104*d*. The side panel 104 is foldably connected to the top panel 102 by the score line 104*c* which is coincident with the score line 102*a*. The first side panel 104 has a length "L" and height "H".

A second side panel 106 is generally rectangular and has four sides, each side defined by a respective score line 106*a*, 106*b*, 106*c*, 106*d*. The side panel 106 is foldably connected to the top panel 102 by the score line 106*a* which is coincident with the score line 102*c*. The first side panel 104 has a length "L" and height "H".

A first partial bottom panel 108 is foldably connected to the side panel 104 by the score line 104*a*, and a comparable second partial bottom panel 110 is foldably connected to the side panel 106 by the score line 106*c*. The two partial bottom panels 108 and 110 are dimensioned so that portions of them overlap when the carrier 100 is assembled, the overlapping portions being glued together to form an overall bottom panel of length "L" and width "W" for the assembled carrier 100.

A first partial end panel 112 is foldably connected to the side panel 104 by the score line 104*b*, and a comparable second partial end panel 114 is foldably connected to the side panel 106 by the score line 106*b*. The two partial end panels 112 and 114 are dimensioned so that portions of them overlap when the carrier 100 is assembled, the overlapping portions being glued together to form an overall first end panel of width "W" and height "H" for the assembled carrier 100.

A third first partial end panel 116 is foldably connected to the side panel 104 by the score line 104*d*, and a comparable fourth partial end panel 118 is foldably connected to the side panel 106 by the score line 106*d*. The two partial end panels 116 and 118 are dimensioned so that portions of them overlap when the carrier 100 is assembled, the overlapping portions being glued together to form an overall opposite second end panel of width "W" and height "H" for the assembled carrier 100.

Flaps 122 and 124 are foldably connected to opposite ends of the partial bottom panel 108 by score lines 108*b* and 108*d*, respectively. Flaps 126 and 128 are foldably connected to opposite ends of the partial bottom panel 110 by score lines 110*b* and 110*d*, respectively. Flaps 132 and 134 are foldably connected to opposite ends of the top panel 102 by score lines 102*b* and 102*d*, respectively. These flaps 122, 124, 126, 128, 132, 134 are adapted to be folded downwardly prior to the flaps 112, 114, 116 and 118 being folded so that they can act as a support against which the flaps 112, 114, 116 and 118 are glued.

The carrier 100 is suitably formed of paperboard having a thickness of approximately 0.38–0.64 mm. When assembled, the carrier 100 has a length "L" of approximately 265 mm, a width "W" of approximately 122 mm, and a height "H" of approximately 197 mm, and provides a strong construction able to hold the weight of twelve full 12 fluid ounce beverage cans. It should be understood that any dimensions set forth herein are merely exemplary, and should not be interpreted as limiting.

The construction of the carrier 100 described hereinabove is generally well known, and many variations in the size or shape of the various panels and flaps can be made merely by changing the design of the cutting and scoring die of standard blank forming or packaging machinery.

HANDLE OPENING

An elongate single handle opening 140 is disposed on the top panel 102, extending transversely between the score lines 102*a* and 102*c*, and located approximately midway along the length of the top panel 102. Preferably, the grain of the paperboard is also aligned transversely across the top panel 102.

As best viewed in FIG. 3, the handle opening 140 is elongate and generally-rectangular, having two parallel opposite sides 142 and 144 and two opposite ends 146 and 148. The ends 146 and 148 are preferably rounded, in the form of semicircles having a diameter equal to the distance (width dimension) between the two sides 142 and 144. The sides 142 and 144 of the handle opening are suitably formed as score lines or intermittent slits, and extend transversely across the top panel 102. The ends 146 and 148 of the handle opening 140 are preferably formed as slits. Another intermittent slit 150 extends from a one end 146 of the opening 140 to the other end 148 of the opening 140 to define two tabs or flaps 152 and 154 which are displaced (separated from one another and folded) by a user urging their fingers against the tabs to dislocate them. Each tab 152, 154 is elongate, has a rounded end, and comprises half of the opening 140. Handle openings having two tabs or flaps are common. It is within the scope of the invention that the handle opening 140 may have only a single tab.

As used herein, a "slit" is a cut which extends completely through the material of the paperboard.

As used herein, an "intermittent slit" is a perforated line which may be produced by a skip-cut operation, which leaves intact narrow widely separated portions of a panel along the intermittent slit line.

As mentioned above, the handle opening 140 is disposed on the top panel 102, extending transversely between the score lines 102*a* and 102*c*, and is located approximately midway along the length of the top panel 102. From end-to-end (146-to-148), the handle opening 140 has a length dimension which is approximately 90 mm, or approximately 70–75% of the width "W" of the top panel 102, and the two sides 142 and 144 are spaced approximately 20 mm apart, or approximately 6–8% of the length "L" of the top panel 102, or approximately 20–25% of the end-to-end dimension of the handle opening 140. In other words, the generally-rectangular handle opening 140 has a length:width ratio of approximately 4–5:1. This is a common size and location on the top panel for a handle opening of such a carrier.

STRESS-RELIEF SCORE LINES

When a user inserts their fingers into the handle opening 140 and lifts the carrier 100, the top panel 102 will tend to bow upward. In order to distribute the lifting stress, a number of stress-relief score lines are formed in the top and side panels 102, 104 and 106.

A stress-relief score line arrangement 160 is formed as follows. A score line 162 extends transversely completely across the top panel 102, from score line 102*a* to score line 102*c*, between the side 142 of the handle opening 140 and the end (score line) 102*b* of the top panel, and has a length equal to the width "W" of the top panel 102. Similarly, a score line 164 extends transversely completely across the top panel 102, from score line 102*a* to score line 102*c*, between the side 144 of the handle opening 140 and the opposite end (score line) 102*d* of the top panel, and has a length equal to the width "W" of the top panel 102. The score line 164 is preferably parallel to the score line 162, and they are spaced a distance apart from one another which is approximately 20–25% of the length "L" of the top panel 102. A semi-circular score line 166 is disposed in the side panel 104 and connects the ends of the two score lines 162 and 164. A semi-circular score line 168 is disposed in the side panel 106 and connects the opposite ends of the two score lines 162 and 164. The score lines 162, 164, 166 and 168 are preferably contiguous with one another. In aggregate, the score lines 162, 164, 166 and 168 form a generally-rectangular stress-relief score line arrangement 160 which extends transversely completely across the top panel 102 and down into the side panels 104 and 106, and which is preferably centered around the handle opening 140. Thus, the carrier 100 can be lifted by the fingers of one hand, the top panel 102 bowing upwardly as the stress relief score line arrangement 160 distributes the lifting stresses through the top panel 102 and the upper portions of the side panels 104 and 106. The stress-relief score line arrangement 160 extends on both sides of the handle opening 140 because the carrier 100 can be lifted by inserting the fingers into the handle opening 140 from either direction.

As best viewed in FIG. 1, an additional arrangement 170 of stress-relief score lines are provided in the top panel 102 as follows. A pair of score lines 172 and 174 extend from a central portion of the score line 162, diverging outwardly to a respective corner of the top panel 102, whereat each score line splits into two score lines 172*a*/172*b* and 174*a*/174*b*, respectively. More particularly, the score line 172 splits into a score line 172*a* intersecting the score line 102*a* and the score line 172*b* intersecting the score line 102*b*. The score line 174 splits into a score line 174*a* intersecting the score line 102*b* and the score line 174*b* intersecting the score line 102*c*. A pair of score lines 176 and 178 extend from a central portion of the score line 164, diverging outwardly to a respective corner of the top panel, whereat each score line splits into two score lines 176*a*/176*b* and 178*a*/178*b*, respectively. More particularly, the score line 176 splits into a score line 176*a* intersecting the score line 102*c* and the score line 176*b* intersecting the score line 102*d*. The score line 178 splits into a score line 178*a* intersecting the score line 102*d* and the score line 178*b* intersecting the score line 102*a*.

Additional stress-relief lines 182 and 184 are disposed on the side panel 104 and extend lengthwise from the semicircular score line 166, as shown. Additional stress-relief lines 186 and 18 are disposed on the side panel 106 and extend lengthwise from the semicircular score line 168, as shown.

In aggregate, the stress-relief lines described hereinabove serve to control bowing of the top panel 102 when the carrier is lifted, distributing stresses to other portions of the carrier, namely to the side panels 104 and 106 and to the corners of the top panel 102.

The advantages of providing score lines in the top and side panels to distribute stress from lifting a carrier having a single opening handle has generally been recognized, for example U.S. Pat. No. 4,785,991 ("Schuster"). In the Schuster patent, slits extending from the ends of the handle opening into the upper portions of the side panels allow the top panel and side panels to flex sufficiently to permit the carrier to be lifted by the handle opening. Score lines in the upper portions of the side panels provide relief from lifting stresses. Additional score lines in the upper panel also provide stress relief.

TEAR-STOP SCORE LINES

Despite the stress-relief measures described hereinabove, both for the carrier of the present invention as well as carriers of the prior art, there may nevertheless be a tendency for a tear to initiate when lifting a fully-loaded carrier. Such a tear will tend to initiate at an edge of the handle opening (140) and, left unchecked, may result in enlarging the opening sufficiently to allow contents of the carrier to fall out. Slits extending from the ends of the handle opening, as described in the Schuster patent, may actually contribute to such tearing of the top panel.

According to the invention, tear-stop score lines are provided closely adjacent the handle opening for preventing tears originating at the handle opening from propagating across the top panel of the carrier.

A tear-stop score line arrangement 190 is formed as follows. A score line 192 extends transversely partially across the top panel 102, generally parallel to and approximately halfway between the score lines 142 and 162. Similarly, a score line 194 extends transversely partially across the top panel 102, generally parallel to and approximately halfway between the score lines 144 and 164. The score line 194 is preferably parallel to the score line 192, and they are spaced a distance (width dimension) apart from one another which is approximately 12–18% of the length "L" of the top panel 102. A semi-circular score line 196 is disposed on the top panel 102 and connects the ends of the two score lines 192 and 194. A semi-circular score line 198 is disposed on the top panel 102 and connects the opposite ends of the two score lines 192 and 194. From end-to-end (196-to-198), the tear-stop score line arrangement 190 has a length dimension which is approximately 85–95% of the distance, or width "W") across the top panel 102. The score lines 192, 194, 196 and 198 are preferably contiguous with one another. In aggregate, the score lines 192, 194, 196 and 198 form a generally-rectangular tear-stop score line arrangement 190 which extends transversely only partially across the top panel 102, without extending down into the side panels 104 and 106, and which is centered around the handle opening 140, between the handle opening 140 and the stress-relief score line arrangement 160.

The tear-stop score line arrangement 190 is approximately 20–30% longer (from end-to-end, across the top panel 102) than the handle opening 140, and is approximately 2–2.5 times wider (from side-to-side) than the handle opening 140. By way of comparison, the stress-relief score line arrangement 160 is approximately 3–4 times wider than the handle opening 140.

The tear-stop score line arrangement 190 encircles (completely surrounds) the handle opening 140, is larger than the handle opening 140, is preferably concentric with the handle opening 140, and is offset from the handle opening 140.

The tear-stop score line arrangement 190 focuses pressure onto the score line arrangement 190 without tearing it. The score line arrangement 190 encircling the handle opening 140 prevents excess pressure from tearing the side panels when lifting the carrier by its integral handle 140. It is possible to incorporate the circular offset score into any integral handle. The advantage of the invention is that is stops excess tearing from side panels without using cutouts for stop tears.

The tear-stop score line arrangement 190 extends on both sides of the handle opening 140 because the carrier 100 can be lifted by inserting the fingers into the handle opening 140 from either direction.

While the invention has been described in combination with embodiments thereof, it is evident that many alternatives, modifications, and variations will be apparent to those skilled in the art in light of the foregoing description. Accordingly, it is intended to embrace all such alternatives, modifications and variations as fall within the spirit and scope of the appended claims.

What is claimed is:

1. A sleeve-type carrier comprising:

a top panel, side panels, end panels and a bottom panel, all interconnected with one another;

a handle opening extending transversely across the top panel; and a tear-stop score line arrangement disposed on the top panel, encircling the handle opening and extending transversely only partially across the top panel.

2. A sleeve-type carrier, according to claim 1, wherein:

the top panel has a length (L) and a width (W);

the handle opening extends approximately 70–75% of the width across the top panel; and the tear-stop score line arrangement extends approximately 85–95% of the width across the top panel.

3. A sleeve-type carrier, according to claim 1, wherein the tear-stop score line arrangement comprises:

a first score line extending transversely partially across the top panel;

a second score line extending transversely partially across the top panel, generally parallel to the first score line and spaced a distance apart from the first score line;

a first semi-circular score line disposed on the top panel and connecting ends of the first and second score lines; and a second semi-circular score line disposed on the top panel and connecting opposite ends of the first and second score lines.

4. A sleeve-type carrier, according to claim 3, wherein:

the first and second score lines and the first and second semi-circular score lines are contiguous with one another.

5. A sleeve-type carrier, according to claim 3, wherein:

the top panel has a length (L) and a width (W);

the distance between the first and second score lines is approximately 12–18% of the length of the top panel.

6. A sleeve-type carrier, according to claim 1, wherein the top panel has a length (L) and a width (W), and the handle opening comprises:

two sides and two ends;

a distance between the two ends is approximately 70–75% of the width of the top panel; and a distance between the two sides is approximately 6–8% of the length of the top panel.

7. A sleeve-type carrier, according to claim 6, wherein:

the sides of the handle opening are formed as score lines or intermittent slits; and the ends of the handle opening are formed as slits.

8. A sleeve-type carrier, according to claim 6, further comprising:

an intermittent slit extending between the ends of the handle opening and defining two tabs or flaps.

9. A sleeve-type carrier, according to claim 1, wherein:

the handle opening has a length dimension;

the tear-stop score line arrangement has a length dimension; and the length dimension of the tear-stop score line arrangement is approximately 20–30% greater than the length dimension handle opening.

10. A sleeve-type carrier, according to claim 1, wherein:

the handle opening has a width dimension;

the tear-stop score line arrangement has a width dimension;

the width dimension of the tear-stop score line arrangement is approximately 2–2.5 times greater than the width dimension of the handle opening.

11. A sleeve-type carrier, according to claim 1, further comprising:

a stress-relief score line arrangement extending transversely completely across the top panel and down into the side panels.

12. A sleeve-type carrier, according to claim 11, wherein the top panel has a length (L) and a width (W), and the stress-relief score line arrangement comprises:

a first score line extending transversely completely across the top panel on a one side of the handle opening;

a second score line extending transversely completely across the top panel, on an opposite side of the handle opening, generally parallel to the first score line and spaced a distance apart from the first score line;

wherein a distance between the first and second score lines is approximately 20–25% of the length of the top panel.

13. A sleeve-type carrier, according to claim 11, wherein:

the tear-stop score line arrangement is disposed between the handle opening and the stress-relief score line arrangement.

14. A sleeve-type carrier, according to claim 11, wherein:

the tear-stop score line arrangement is disposed approximately halfway between the handle opening and the stress-relief score line arrangement.

15. A paperboard blank for a sleeve-type carrier comprising:

a plurality of panels foldably connected to one another by a plurality of score lines, a one panel of which comprises a top panel for the carrier;

a handle opening extending transversely across the top panel;

a tear-stop score line arrangement disposed on the top panel, encircling the handle opening and extending transversely only partially across the top panel.

16. A paperboard blank for a sleeve-type carrier, according to claim 15, wherein:

the top panel has a length (L) and a width (W);

the handle opening extends approximately 70–75% of the width across the top panel; and the tear-stop score line arrangement extends approximately 85–95% of the width across the top panel.

17. A paperboard blank for a sleeve-type carrier, according to claim 15, wherein:

the handle opening has a length dimension and a width dimension;

the tear-stop score line arrangement has a length dimension and a width dimension;

the length dimension of the tear-stop score line arrangement is approximately 20–30% greater than the length dimension handle opening; and the width dimension of the tear-stop score line arrangement is approximately 2–2.5 times greater than the width dimension of the handle opening.

18. A paperboard blank for a sleeve-type carrier, according to claim 15, wherein the top panel has a length (L) and a width (W), further comprising:

a stress-relief score line arrangement comprising a first score line extending transversely completely across the top panel on a one side of the handle opening;

a second score line extending transversely completely across the top panel, on an opposite side of the handle opening, generally parallel to the first score line and spaced a distance apart from the first score line;

wherein a distance between the first and second score lines is approximately 20–25% of the length of the top panel.

19. A paperboard blank for a sleeve-type carrier, according to claim 18, wherein:

the tear-stop score line arrangement is disposed between the handle opening and the stress-relief score line arrangement.

20. A paperboard blank for a sleeve-type carrier, according to claim 18, wherein:

the tear-stop score line arrangement is disposed approximately halfway between the handle opening and the stress-relief score line arrangement.

* * * * *